US006558061B2

(12) United States Patent
Petit

(10) Patent No.: US 6,558,061 B2
(45) Date of Patent: May 6, 2003

(54) POWDER DISPENSER WITH TELESCOPIC BRUSH

(75) Inventor: Robert Petit, Chevilly-Larue (FR)

(73) Assignee: Lir France, Chevilly-Larue (FR)

( * ) Notice: Subject to any disclaimer, the term of this patent is extended or adjusted under 35 U.S.C. 154(b) by 0 days.

(21) Appl. No.: 10/112,095

(22) Filed: Apr. 1, 2002

(65) Prior Publication Data

US 2002/0181998 A1 Dec. 5, 2002

(30) Foreign Application Priority Data

Apr. 4, 2001 (FR) ..... 01 04572

(51) Int. Cl.[7] ..... A46B 11/04

(52) U.S. Cl. ..... 401/270; 15/201; 15/205.2; 401/288; 401/289

(58) Field of Search ..... 401/270, 289, 401/288, 286, 282; 15/201, 205.2

(56) References Cited

U.S. PATENT DOCUMENTS 1,355,026 A 10/1920 Austin
2,236,030 A * 3/1941 Hall ..... 401/288
4,626,119 A 12/1986 Ladd, Jr.
4,944,625 A * 7/1990 Futter et al. ..... 401/270 X
5,397,195 A 3/1995 Goncalves

* cited by examiner

*Primary Examiner*—David J. Walczak
*Assistant Examiner*—Kathleen J. Prunner
(74) *Attorney, Agent, or Firm*—Connolly Bove Lodge & Hutz LLP

(57) ABSTRACT

A dispenser includes a brush fixed to a powder reservoir having a tuft of hair and a tuft holder provided with a first powder supply orifice. The reservoir is closed by a shutter in which a second powder supply orifice is formed, and that can be turned manually with respect to the tuft holder to align the first and second orifices. The shutter of the reservoir includes a central duct with a bottom in which the second orifice is formed. The tuft holder has a lower tubular part with a bottom wherein the said first orifice cooperates with the central duct to provide axial securement and free rotation, an upper tubular part fitting tightly around the said tuft and a said first skirt. The dispenser includes a guide that has an axial displacement tab, the lower end of which supports a radial pin, and the central duct carries a helical ramp on its outer surface that cooperates with the pin such that rotation of the guide causes an axial movement of the guide.

17 Claims, 9 Drawing Sheets

POWDER DISPENSER WITH TELESCOPIC BRUSH

FIELD OF THE INVENTION

The invention relates to the field of powder dispensers and more particularly dispensers fitted with a brush used for application of the said powder on a support. In general, the said powder is a cosmetic product and the said support is facial skin.

STATE OF THE ART

Powder dispensers provided with a brush are already known, for example like that described in European patent No. 89111474.6 or in American patent No. 4,626,119.

PROBLEMS THAT ARISE

Known dispensers have a number of disadvantages. Thus, the dispenser according to the European patent application No. 89111474.6 comprises a brush fixed to a powder reservoir used as a gripping means, but does not include any means for protecting the brush integrated into the powder reservoir, nor does it include a non-circular shaped dispenser and brush.

Similarly, the dispenser described in U.S. Pat. No. 4,626,119 comprises a brush that may be filled with powder but it does not contain a powder reservoir fixed to the brush, nor does it include a non-circular shaped dispenser and brush.

PURPOSE OF THE INVENTION

The purpose of the invention is an arbitrary shaped powder dispenser, typically non-circular, comprising a brush fixed to a powder reservoir used as a manual gripping means, the said brush and the said reservoir being in communication while the brush is used, and comprising a means of protecting the brush that can be activated manually, activation of this protection means simultaneously cutting off communication between the said brush and the said reservoir.

DESCRIPTION OF THE INVENTION

According to the invention, the powder dispenser comprises a brush fixed to a powder reservoir and in communication with the said reservoir, the said reservoir acting as a manual means of gripping the said dispenser. In this dispenser, the said brush consists of a tuft of hair and a hair holder provided with a first powder supply orifice, the said reservoir that may contain powder comprises a peripheral skirt with an opening that is closed off by a shutter in which there is a second powder supply orifice, and the said brush can be turned manually with respect to the said reservoir to align the said first and second supply orifices so that the said dispenser can be used.

This dispenser is characterized in that:

a) the said reservoir shutter comprises a central duct with a bottom in which the said second orifice is formed, b) the said tuft holder comprises a lower tubular part with a bottom that comprises the said first orifice, the said lower tubular part cooperating with the said central duct to enable free rotation, and possibly an axial connection between the said tuft holder and the said shutter, an upper tubular part in communication with the said lower tubular part surrounding the said tuft, and a first said skirt fixed to the said lower tubular part or upper tubular part and with a section typically similar to the section of the said reservoir, the said first skirt being located approximately above the said shutter and above the said reservoir in the axial direction, to enable the said free rotation regardless of the shape of the reservoir, c) it comprises a guide, the said guide comprising a said second skirt coaxial with the said first skirt and that can slide along the said first skirt and outside the said first skirt, d) the said guide comprises an axial displacement tab, the lower end of which supports a radial pin, and the said central duct supports a typically helical ramp on its outer surface that cooperates with the said pin such that rotation of the said guide, and simultaneous rotation of the said tuft holder with respect to the said shutter or the said reservoir, causes an axial movement of the said guide with respect to the said tuft holder, in order to protect or disengage the said tuft depending on the axial position of the said guide with respect to the said tuft holder.

Thus, the dispenser according to the invention solves all the problems that arise.

The powder dispenser according to the invention may be of any arbitrary shape. It comprises a brush fixed to a powder reservoir used as a manual gripping means, the said brush and the said reservoir being in communication while the brush is being used. It comprises a guide, which is rotated manually to form a means of protecting the brush that can be activated manually, and activating this means of protecting the tuft simultaneously interrupts the communication between the said brush and the said reservoir.

DESCRIPTION OF THE FIGURES

All the figures apply to a dispenser or dispenser element according to the invention.

FIGS. 1 to 10*d* relate to a first embodiment of the invention.

FIGS. 11 to 12*b* apply to other embodiments of the invention.

FIGS. 1 to 4, 5*a*, 6*a*, 7*a*, 8*a*, 9*a* and 10 are perspective views, and FIGS. 1 to 4 are partially exploded views.

FIGS. 5*d*, 6*d*, 7*d*, 8*d*, 9*d* and 10*d* are side views, along the short side.

FIG. 11 is an axial section along the vertical axis.

FIGS. 12*a* and 12*b* are sections in a horizontal plane along plane I—I shown in FIG. 11.

FIGS. 1 and 2 show a dispenser (1) when the guide (6) is not deployed, FIG. 2 is a partial view showing more detail than FIG. 1.

FIGS. 3 and 4 show the same dispenser (1) when the guide (6) is deployed, FIG. 4 is a partial view showing more detail than FIG. 3.

FIGS. 5*a* to 5*d* show the shutter (5) of the dispenser (1) in FIGS. 1 to 4.

FIGS. 6*a* to 6*d* show the guide holder (7) of the dispenser (1) in FIGS. 1 to 4.

FIGS. 7*a* to 7*d* show the tuft holder (3) of the dispenser (1) in FIGS. 1 to 4.

FIGS. 8*a* to 8*d* show the guide (6) of the dispenser (1) in FIGS. 1 to 4.

FIGS. 9*a* to 9*d* show the removable cap (8) of the dispenser (1) in FIGS. 1 to 4.

FIGS. 10*a* to 10*d* show the reservoir (4) of the dispenser (1) in FIGS. 1 to 4.

FIG. 11 shows another embodiment of the dispenser (1) according to the invention, and FIGS. 12*a* and 12*b* show two variants of this embodiment. de The dispenser has a round section in FIGS. 11 and 12*a*, and a square section in FIGS. 11 and 12*b*.

DETAILED DESCRIPTION OF THE INVENTION

Figure 1:
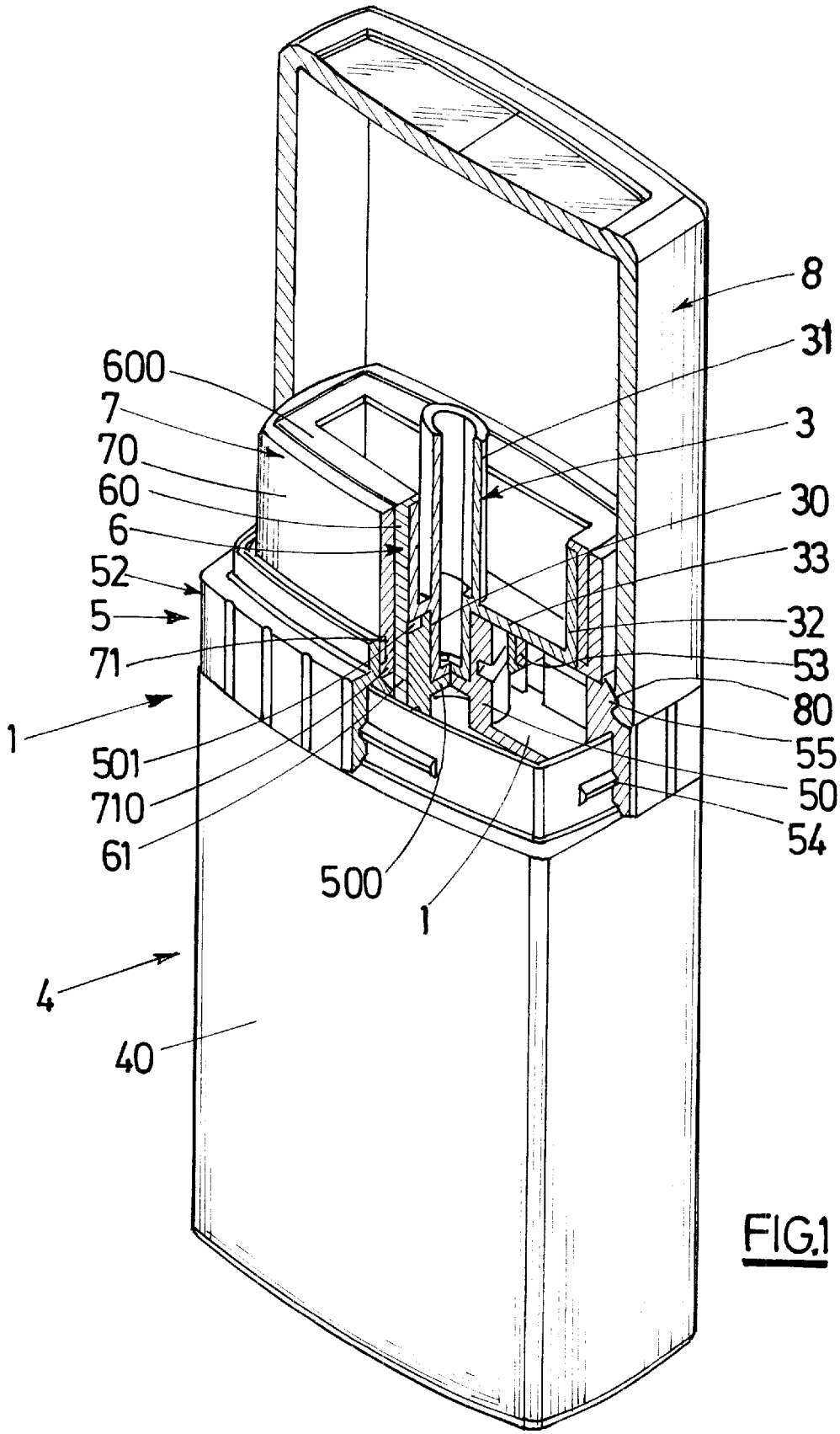
Figure 2:
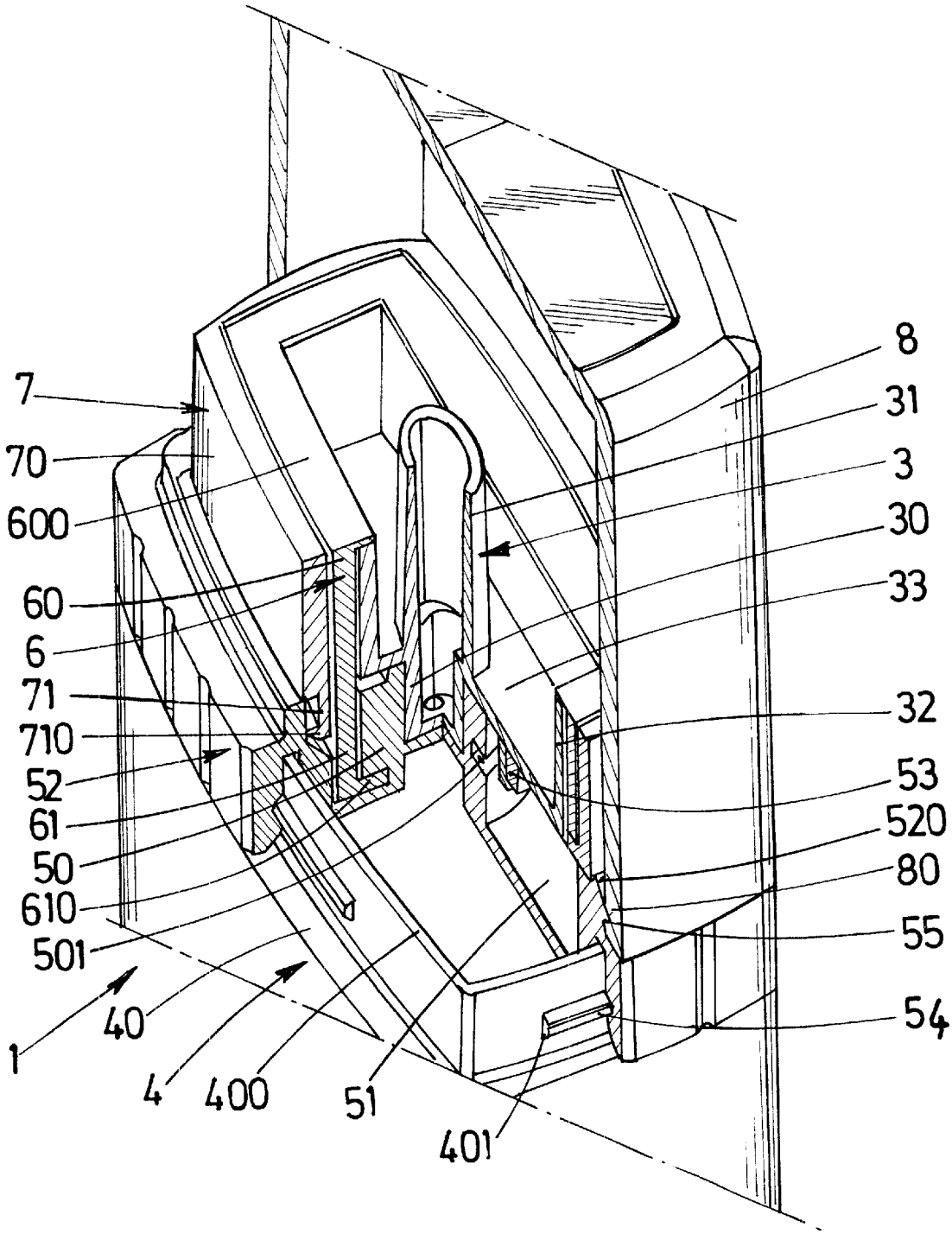
Figure 3:
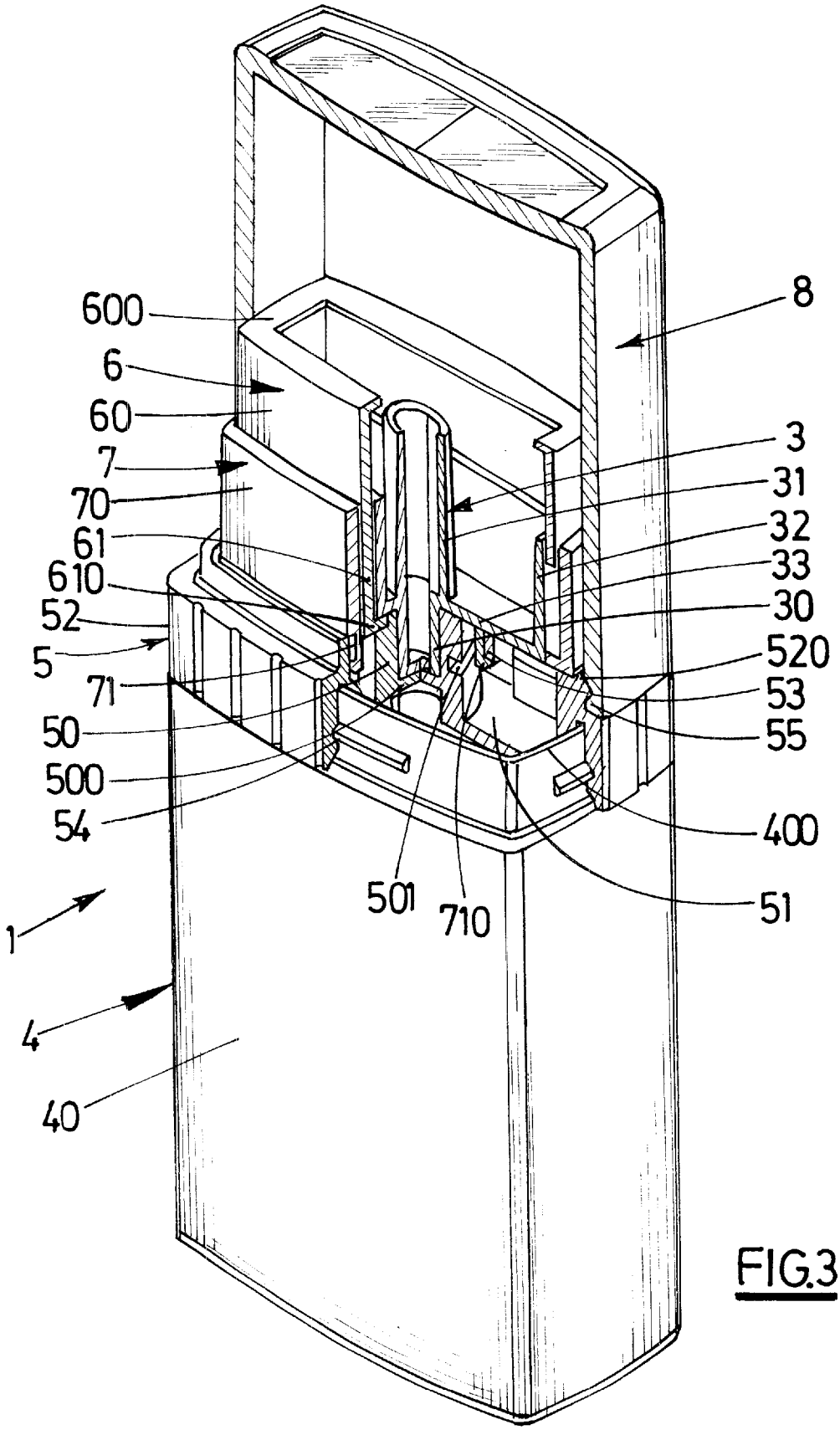
Figure 4:
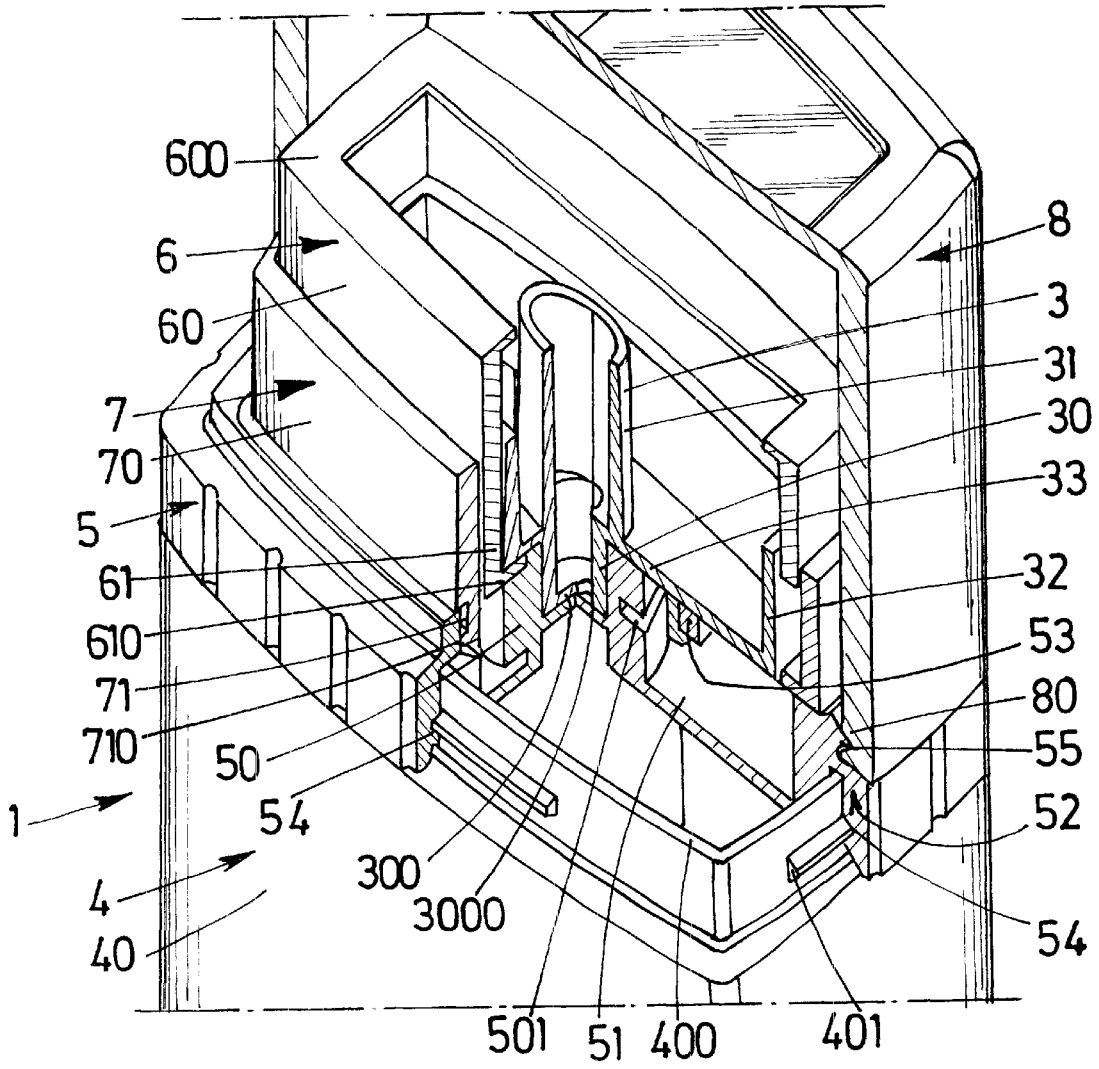

In the dispenser according to the invention, the said shutter (5) may comprise a central panel (51) in the middle of which the said duct (50) is located, the said duct (50) being at a distance from the said peripheral skirt (40) equal to at least the thickness of the said tab (61), to enable rotation of the said guide (6) with respect to the said shutter (5). The dispensers shown in the figures comprise a panel (51) that closes the upper opening of the reservoir (4), but depending on the dimensions of this opening, this panel may be of variable size and possibly may not even exist in the case of a relatively small opening.

As illustrated in FIGS. 1 to 4 and 5*a* to 5*d*, the said shutter (5) may comprise an external rim (52) higher than the said central panel (51) and with an inverted "U" shape so as to fix the said outer rim (52), typically by a force fit or a click fit by cooperation of male and female elements, on the upper end (400) of the said peripheral skirt (40). This outer inverted "U" shaped rim forms a collar around this upper end (400).

Figure 11:
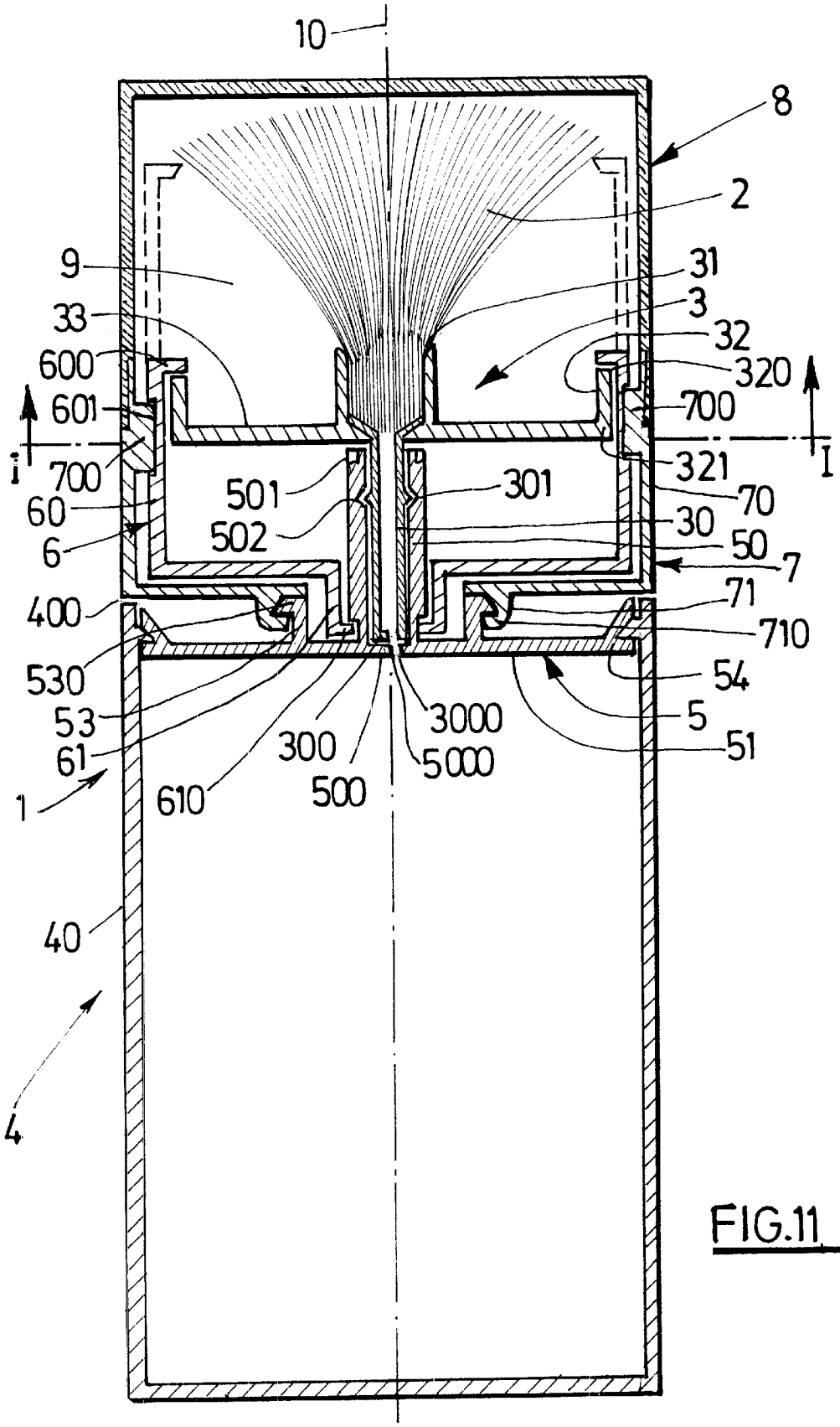

But as shown in FIG. 11, the said shutter (5) may be fixed, typically by a force fit or a click fit, inside the said peripheral skirt (40).

Typically, the height of the said second skirt (60) may be between 2 and 5 cm, particularly as a function of the height of the said tuft, equal to at least the height of the said first skirt (32), in order to allow the said tuft to project sufficiently when the said powder is applied to the skin, and also to protect it when the dispenser is not being used.

As shown in FIGS. 1 to 4 and 11, the said second skirt (60) may have an upper rim (600) that covers the upper end (320) of the said first skirt (32), particularly for aesthetic reasons.

According to the invention, and as shown in FIG. 11, the said tuft holder (3) may cooperate with the said shutter (5), in order to fix the tuft holder (3) and the said shutter (50) together in the axial direction while allowing free rotation between them, and thus irreversibly block the said guide (6) in the axial direction, typically by a click fit (301, 502).

Figure 5C:
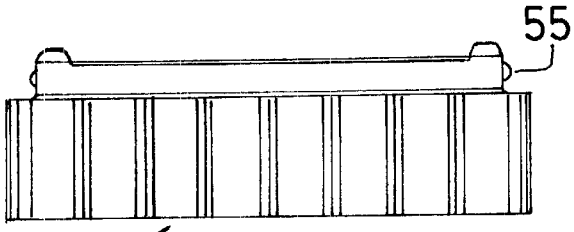
FIGS. 5*c*, 6*c*, 7*c*, 8*c*, 9*c* and 10*c* are side views, along the long side.
Figure 5D:
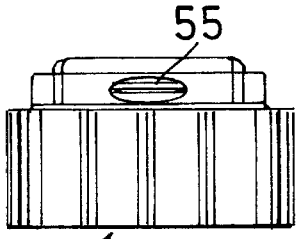
Figure 5B:
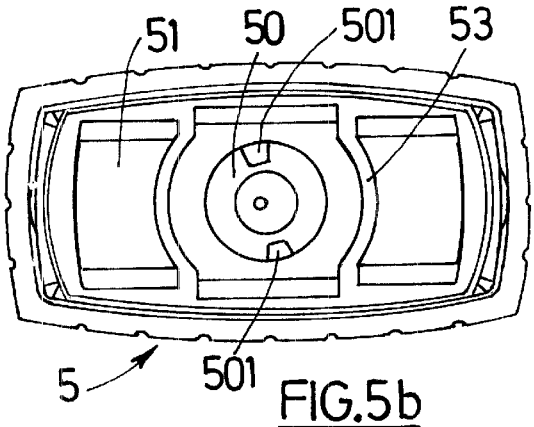
FIGS. 5*b*, 6*b*, 7*b*, 8*b*, 9*b* and 10*b* are top views.
Figure 5A:
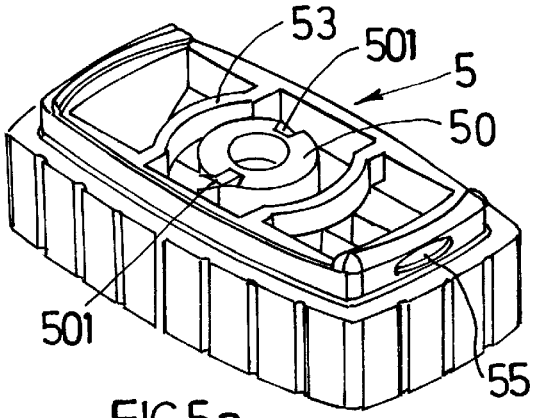
Figure 6C:
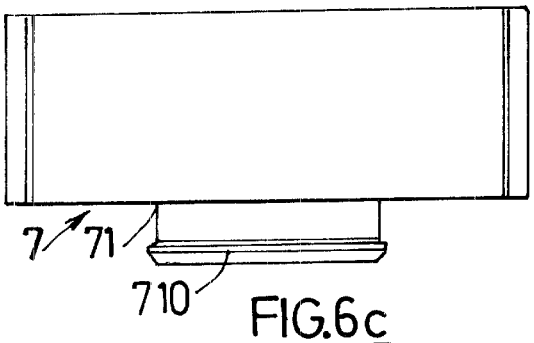
Figure 6D:
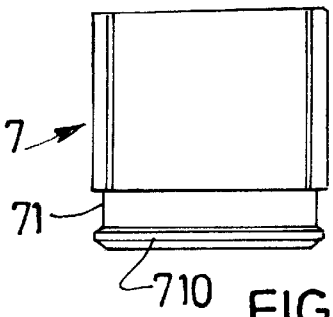
Figure 6B:
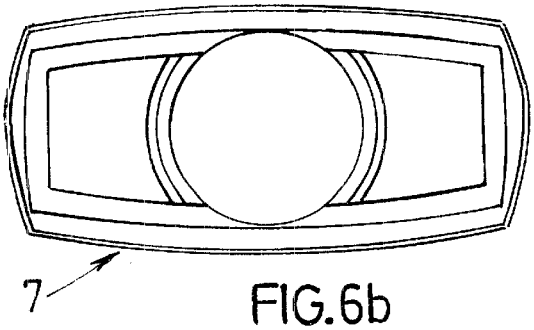
Figure 6A:
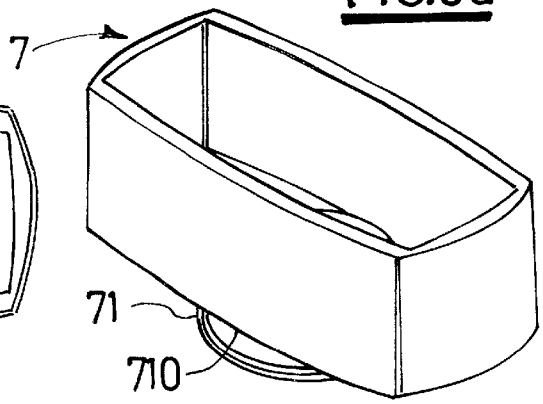
Figure 7C:
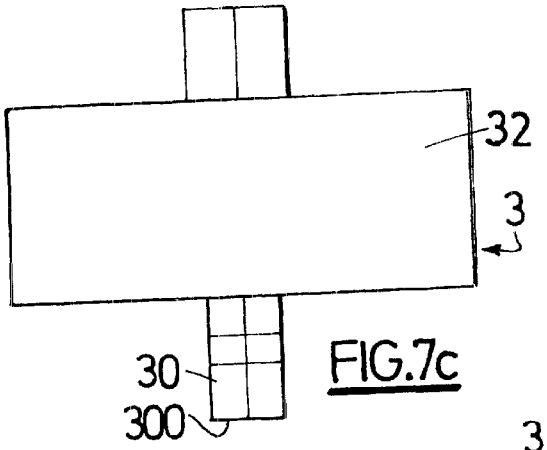
Figure 7D:
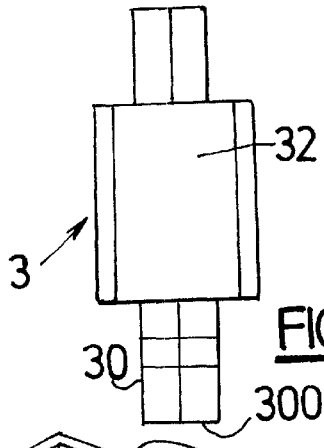
Figure 7B:
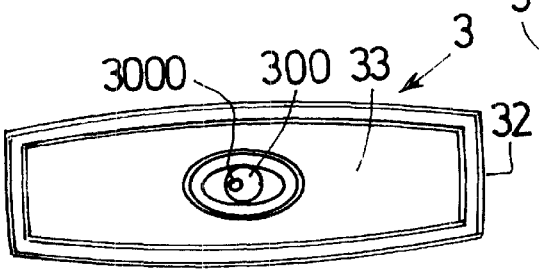
Figure 7A:
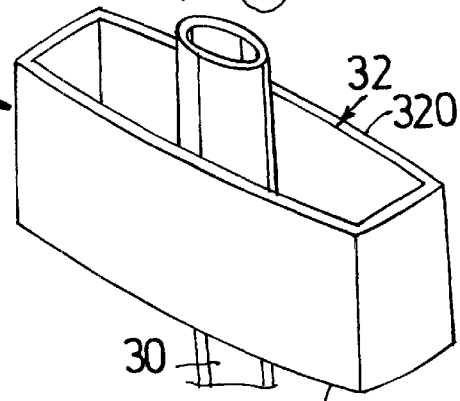
Figure 8D:
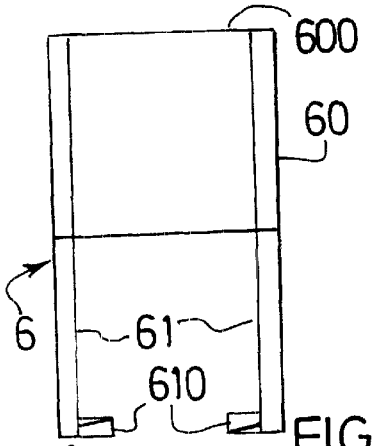
Figure 8C:
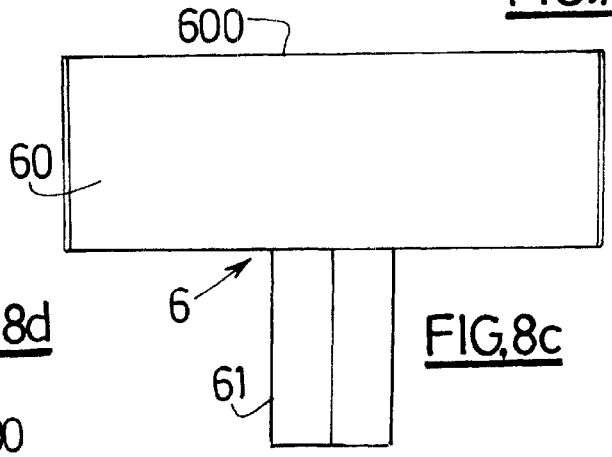
Figure 8A:
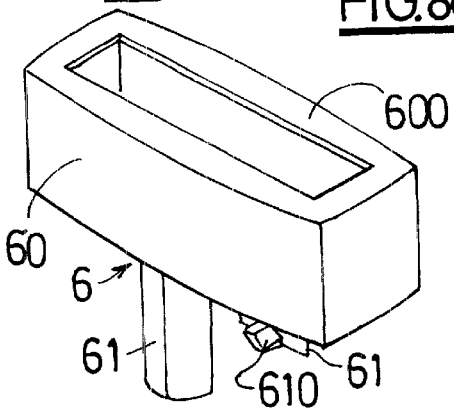
Figure 8B:
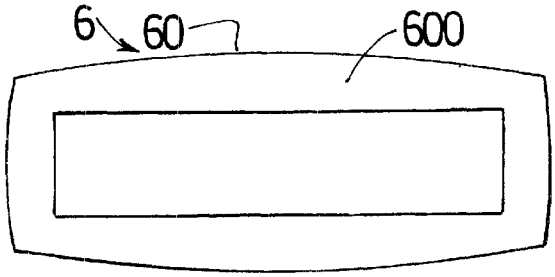
Figure 9C:
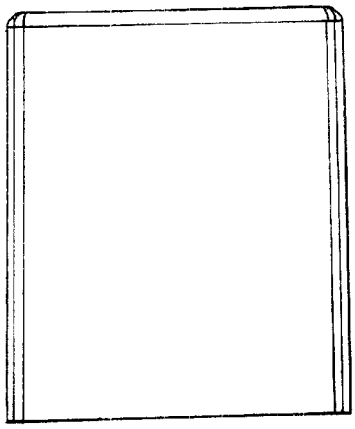
Figure 9D:
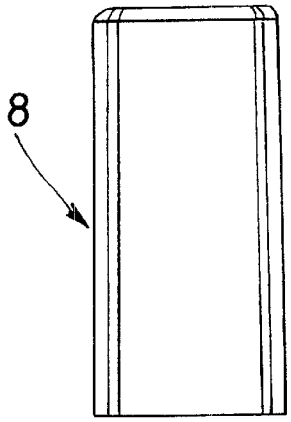
Figure 9B:
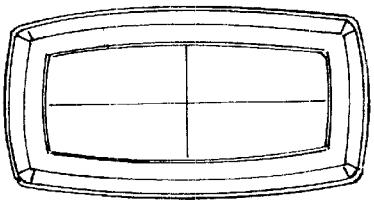
Figure 9A:
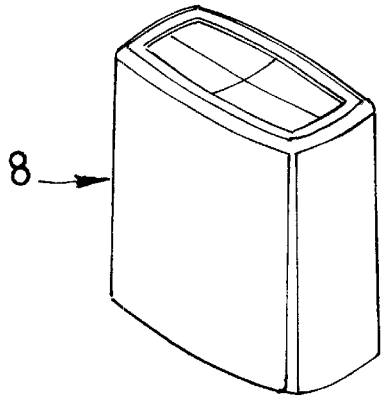
Figure 10D:
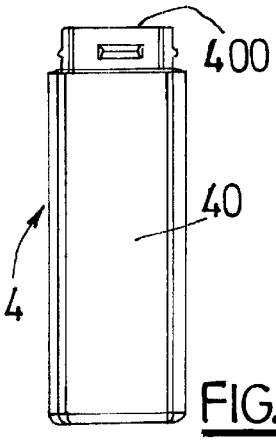
Figure 10C:
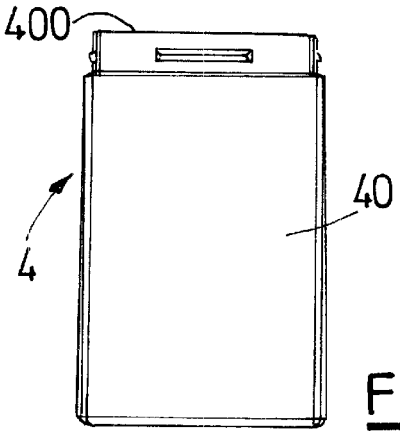
Figure 10A:
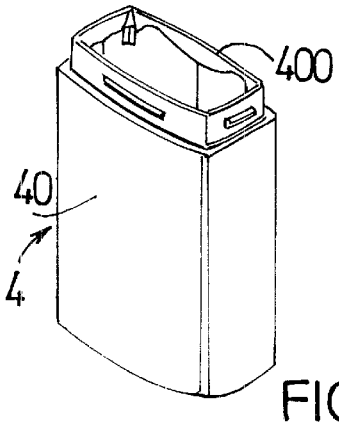
Figure 10B:
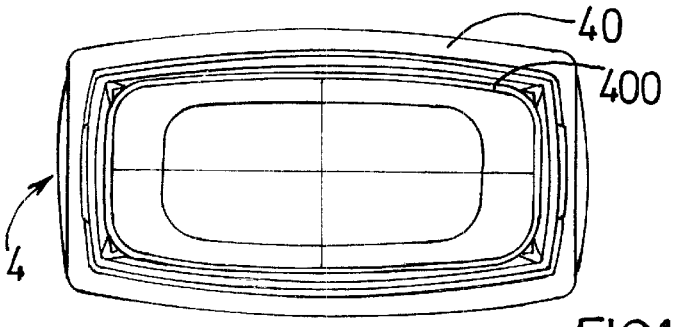

As shown in FIGS. 8*a* and 8*d*, the said guide (6) may comprise two axial displacement tabs (61) at 180° from each other, and in this case, the said central duct (50) is fitted with two helical ramps (501) oriented at 180° from each other with respect to a vertical axis (10) of the dispenser as shown particularly in FIGS. 5*a* and 5*b*.

According to an embodiment of the invention shown in the figures, the said dispenser (1) may comprise a guide holder (7) provided with a said third skirt (70) fixed with respect to the said tuft holder (3), the said third skirt (70) being similar to the said first skirt (32) and second skirt (60), and outside the said second skirt (60), such that the said first skirt (32) and the third skirt (70) form two approximately equidistant walls between which the said second skirt (60) of the guide (6) may be displaced axially, the said third skirt (70) being located above the said shutter (5) and above the said reservoir (4) in the axial direction, in order to enable the said simultaneous free rotation of the said first skirt (32), second skirt (60) and third skirt (70), regardless of the shape or the section of the said reservoir (4).

This is a preferred embodiment of the invention particularly for aesthetic reasons. But technically, the guide holder (7) is not essential to solve the problem addressed by this invention. The guide (6) is positioned radially particularly by the said first skirt (32) of the tuft holder (3) and is axially positioned by cooperation between the pins (610) of the tabs (61) and the helical ramp (501) of the central duct (50) of the shutter (5) such that the guide holder (7) does not have to be present to enable axial displacement of the guide (6).

As illustrated particularly in FIGS. 6*a* to 6*d*, the said guide holder (7) may comprise a lower circular ring (71) comprising a typically irreversible means of attachment (710) to the said shutter (5).

As can be seen in FIGS. 5*a* and 5*b*, the said shutter (5) may comprise contact surfaces (53) forming arcs coaxial with the said central duct (50) to make the said attachment.

According to the invention, the said dispenser may comprise a removable cover (8) covering the said tuft (2) and that can be fixed reversibly, typically by a click fit by cooperation between male (54) and female (80) elements on the said shutter (5) or on the upper end (400) of the said peripheral skirt (40).

According to FIGS. 1 to 4, the said cover click fits onto the said shutter (5). On the other hand, in FIG. 11 the said cover cooperates with the upper end of the said third skirt (70) of the guide holder (7), particularly to have a dispenser with the same section for the said reservoir (4), the said guide holder (7) and the said cover (8).

As illustrated in FIGS. 1 to 4, 7*b* and 11, the said first skirt (32) may be fixed to the said lower tubular part (30) or upper tubular part (31) by a typically plane panel (33) extending between the said lower tubular part (30) or upper tubular part (31) and the said first skirt (32), but radial contact surfaces or other variants could perform the same role.

Typically, the panel (33) may make the base (321) of the said first skirt (32) rigidly attached to the upper end of the said lower tubular part (30), and/or the lower part of the said upper tubular part (31).

According to the invention, the said free rotation of the said tuft holder (3) and the said guide (6) with respect to the said shutter (5) may typically be as much as 180° or 360°, the said shutter (5) comprising means of stopping the said rotation at predetermined values corresponding to a similar position of the said. tuft holder (3) and the said guide (6) with respect to the said shutter (5).

Thus, as shown in FIGS. 1 to 4, the said means may typically comprise an upper edge (520) forming an overthickness that may or may not be locally supported by the said outer rim (52) in order to provide slight resistance to the said rotation when the said rotation is not close to the said predetermined values.

Figure 12A:
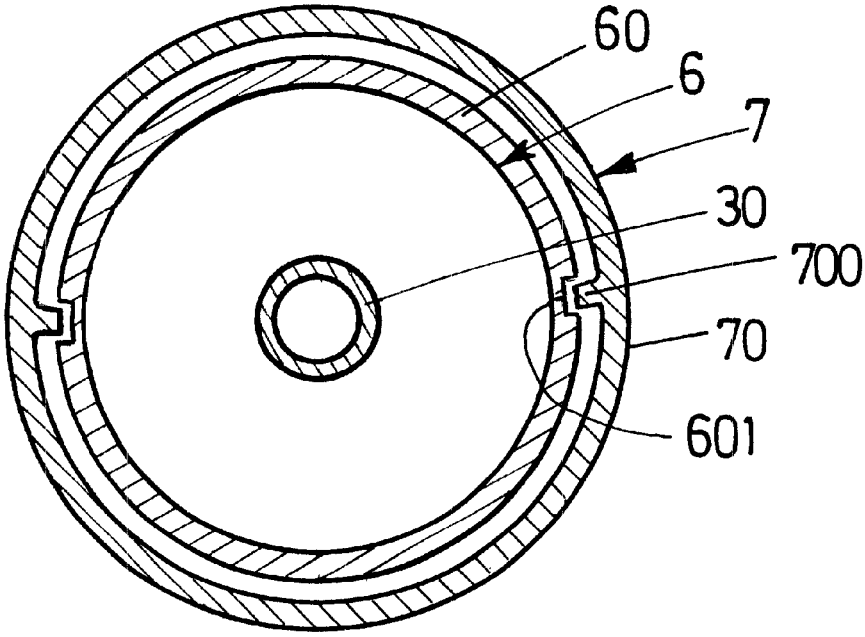
Figure 12B:
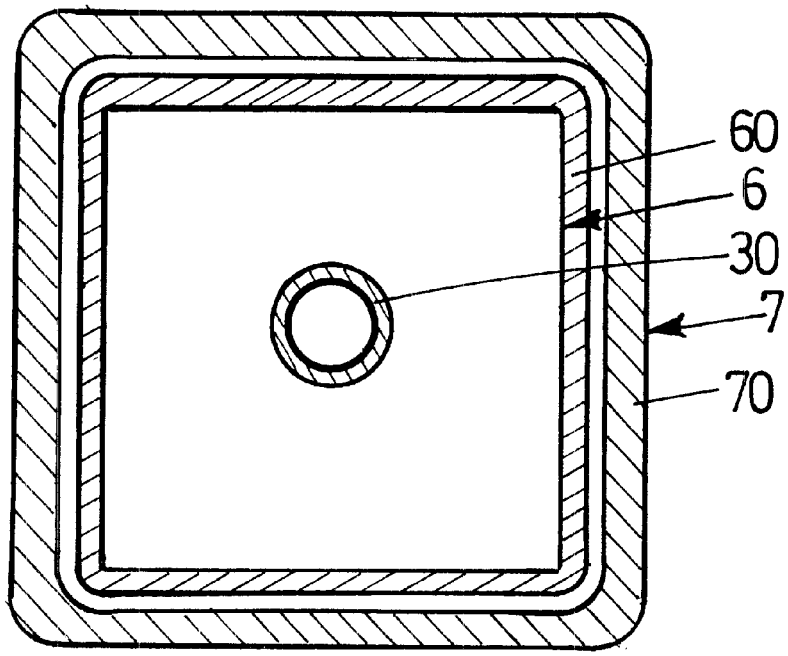

A similar type of means may be used in the variant represented by the combination in FIGS. 11 and 12*b*, in which it is possible to have predetermined values equal to 90–180–270 and 360°. In the case of a dispenser(1) with a circular cross section, like that shown by the combination of FIGS. 11 and 12*a*, all that is necessary is to provide cooperation between male and female elements respectively on the upper end (400) of the skirt (40) of the reservoir (4), and under the lower end of the skirt (70) of the guide holder (7). These male and female elements are not shown in FIG. 11.

The dispenser according to the invention may have any arbitrary shape. It may typically be round as shown in FIG. 12*a*, or square as illustrated in FIG. 12*b* or rectangular or oblong as illustrated in FIGS. 1 to 10*d*.

EXAMPLE EMBODIMENTS

The dispenser has been made according to FIGS. 1 to 10*b*.

This was done by making a tuft holder (3), a reservoir (4), a shutter (5), a guide (6), a guide holder (7) and a cover (8), by moulding a thermoplastic material. The first step was to assemble the guide (6) and then the guide holder (7) to the tuft holder (3). This assembly was click fitted onto the shutter (5) that was itself click fitted onto the reservoir (4).

The embodiments in FIGS. 11 and 12*a*–12*b* were also manufactured in this way.

Advantages of the Invention

Firstly, with the invention, the user can make a single action causing a relative rotation of one part of the dispenser with respect to another part of the dispenser, to release the tuft of the brush and to put the reservoir into communication with the bottom of the tuft. The user can then make the reverse movement to close off the reservoir and protect the tuft of the brush.

Secondly, the invention may be adapted to different shapes of dispensers.

Furthermore, the invention is a means of renewing the image of dispensers.

Finally, the dispenser according to the invention consists of a limited number of parts that can easily be assembled typically by a single axial click fit movement.

| List of reference marks | |
|---|---|
| Dispenser | 1 |
| Vertical axis | 10 |
| Tuft of hair | 2 |
| Tuft holder | 3 |
| Lower tubular part | 30 |
| Bottom | 300 |
| First orifice | 3000 |
| Male click fit element | 301 |
| Upper tubular part | 31 |
| First skirt | 32 |
| Upper end | 320 |
| Base or lower end | 321 |
| Plane panel | 33 |
| Reservoir | 4 |
| Peripheral skirt | 40 |
| Upper end | 400 |
| Click fit means | 401 |
| Shutter | 5 |
| Central duct | 50 |
| Bottom of duct | 500 |
| Second orifice | 5000 |
| Helical ramp | 501 |
| Female click fit element | 502 |
| Central panel | 51 |
| Outer inverted "U" rim | 52 |
| Upper edge | 520 |
| Arc shaped contact surface | 53 |
| Attachment means | 530 |
| Female attachment element | 54 |
| Male attachment element | 55 |
| Guide | 6 |
| Second skirt | 60 |
| Upper rim | 600 |
| Vertical groove | 601 |
| Axial displacement tab | 61 |
| Pin | 610 |
| Guide holder | 7 |
| Third skirt | 70 |

-continued

| List of reference marks | |
|---|---|
| Vertical groove | 700 |
| Lower circular ring | 71 |
| Attachment means | 710 |
| Cover | 8 |
| Female attachment element | 80 |
| Brush (2 + 3) | 9 |

What is claimed is:

1. A powder dispenser comprising a brush fixed to a powder reservoir and in communication with the reservoir, the reservoir acting as a manual means of gripping the dispenser, in which the brush includes a tuft of hair and a tuft holder provided with a first powder supply orifice, in which the reservoir that may contain powder has a peripheral skirt with an opening that is closed off by a shutter in which there is a second powder supply orifice, and in which the brush can be turned manually with respect to the reservoir to align the first supply orifice and second supply orifice so that the dispenser can be used, and wherein:

a) the shutter of the reservoir includes a central duct with a bottom in which the second orifice is formed, b) the tuft holder comprises a lower tubular part with a bottom that has the first orifice, the lower tubular part cooperating with the central duct to enable free rotation, and possibly an axial connection between the tuft holder and the shutter, an upper tubular part in communication with the lower tubular part surrounding the tuft and forming a powder supply duct to the tuft, and a first skirt fixed to the lower tubular part or upper tubular part and with a section similar to the section of the reservoir, the first skirt being located approximately above the shutter and above the reservoir in the axial direction, to enable the free rotation regardless of the shape of the reservoir, c) the dispenser including a guide, the guide having a second skirt coaxial with the first skirt and that can slide along the outside of the first skirt, d) the guide having an axial displacement tab, the lower end of which supports a radial pin, and the central duct supports a helical ramp on its outer surface that cooperates with the pin such that rotation of the guide, and simultaneous rotation of the tuft holder with respect to the shutter or the reservoir, causes an axial movement of the guide with respect to the tuft holder, in order to protect or disengage the tuft depending on the axial position of the guide with respect to the tuft holder.

2. A dispenser according to claim 1, in which the shutter comprises a central panel in the middle of which the duct is located, the duct being at a distance from the peripheral skirt equal to at least the thickness of the tab to enable the guide to rotate with respect to the shutter.

3. A dispenser according to claim 2, in which the shutter comprises an outer rim projecting above the central panel and in the shape of a "U" to fix the outer rim by a force fit or a click fit by cooperation of male and female elements, on an upper end of the peripheral skirt.

4. A dispenser according to claim 2, in which the shutter is fixed, by a force fit or a click fit, inside the peripheral skirt.

5. A dispenser according to claim 1, in which the height of the second skirt is between 2 and 5 cm, equal to at least the height of the first skirt.

6. A dispenser according to claim 5, in which the second skirt has an upper rim that covers an upper end of the first skirt.

7. A dispenser according to claim 1 , in which the tuft holder cooperates with the shutter, in order to irreversibly fix the tuft holder and the shutter together, by a click fit in the axial direction while allowing them to rotate with respect to each other, and thus to fix the guide in position in the axial direction.

8. A dispenser according to claim 1 in which the guide comprises two axial displacement tabs at 180° from each other, and the central duct supports two helical ramps oriented at 180° from each other with respect to a vertical axis of the dispenser.

9. A dispenser according to claim 1, comprising a guide holder fitted with a third skirt fixed with respect to the tuft holder, the third skirt being similar to the first skirt and second skirt, and outside the second skirt such that the first skirt and third skirt form two approximately equidistant walls between which the second skirt of the guide may be moved axially, the third skirt being located above the shutter and above the reservoir in the axial direction in order to enable the free simultaneous rotation of the first skirt, second skirt and third skirt, regardless of the shape or the section of the reservoir.

10. A dispenser according to claim 9, in which the guide holder comprises a lower circular ring having a means for fixing the shutter irreversibly.

11. A dispenser according to claim 10, in which the shutter includes contact surfaces forming arcs coaxial with the central duct to enable the attachment.

12. A dispenser according to claim 1 having a removable cover that covers the tuft and that can be fixed reversibly, by a click fit and by cooperation between male and female elements on the shutter or on an upper end of the peripheral skirt.

13. A dispenser according to claim 1 in which the first skirt is fixed to the lower tubular part or upper tubular part by means of a plane panel extending between the lower tubular part or upper tubular part and the first skirt.

14. A dispenser according to claim 13 in which the panel rigidly fixes a base of the first skirt to an upper end of the lower tubular part and/or to a lower end of the upper tubular part.

15. A dispenser according to claim 1 in which the free rotation of the tuft holder and the guide with respect to the shutter typically extends to 180° or 360°, the shutter having means of stopping the rotation at predetermined values corresponding to a similar position of the tuft holder and the guide with respect to the shutter.

16. A dispenser according to claim 15, in which the means for stopping the rotation includes an upper edge forming an overthickness that may or may not be locally supported by an outer rim that provides slight resistance to the rotation when the rotation moves away from the predetermined values.

17. A dispenser according to claim 1 , having a round, square, rectangular or oblong shape.

* * * * *